US005101895A

United States Patent [19]

Gilbert

[11] Patent Number: 5,101,895

[45] Date of Patent: Apr. 7, 1992

[54] WELL ABANDONMENT SYSTEM

[75] Inventor: Horace E. Gilbert, Ellon, Scotland

[73] Assignee: Smith International, Inc., Houston, Tex.

[21] Appl. No.: 632,251

[22] Filed: Dec. 21, 1990

[51] Int. Cl.[5] ..... E21B 29/00

[52] U.S. Cl. ..... 166/55.8; 294/86.34

[58] Field of Search ..... 166/301, 55.7, 55.8, 166/98, 187; 294/86.34, 86.17, 86.24, 86.25

[56] References Cited

U.S. PATENT DOCUMENTS 3,087,546 4/1963 Woolley ..... 166/55.8 X 3,332,492 7/1967 Thomas ..... 166/55.8 X 3,489,211 1/1970 Kammerer, Jr. ..... 166/55.8 X 4,047,568 9/1977 Aulenbacher ..... 166/55.8 X 5,010,955 4/1991 Springer ..... 166/55.8 X

*Primary Examiner*—William P. Neuder

*Attorney, Agent, or Firm*—Robert M. Vargo

[57] ABSTRACT

A remedial bottom hole assembly for casing retrieval is disclosed having a spear and an inflatable packer utilized in combination with a pipe cutter. With such an assembly, after the spear is set and the casing is cut, the packer can be inflated to determine if circulation can be established without the removal of the spear and pipe cutter.

4 Claims, 4 Drawing Sheets

WELL ABANDONMENT SYSTEM

BACKGROUND OF THE INVENTION

1. Field of the Invention

The present invention relates generally to well abandonment tools for cutting and pulling casing and more particularly to casing retrieval systems for performing various functions in a single trip.

2. Description of the Prior Art

When it was required to cut the casing string in deep water from a semi-submersible rig, or to cut the casing string below 1,000 feet on a platform or jackup rig, the normal procedure was to cut the casing string with a conventional hydraulic pipe cutter. If the operator wanted to establish circulation, the rig's hydraulic blowout preventer was closed on the work string-casing annulus and pump pressure was applied to the work string. This procedure created a problem because the operation tended to damage the rig's blowout preventer and, as a result, was not considered a good operational procedure.

Heretofore, most operators preferred to pull the cutting tool from the wellbore and then use a casing spear and packoff. In this procedure, after the spear was set, pressure was applied to the workstring and circulation was attempted. There are several reasons for establishing circulation around the cut piece of pipe. The first reason is to ensure that there is no build up of gas bubbles. The second reason is to ensure that the pipe is cut and in condition to be retrieved, i.e. free of drilling fluid sediments or sand. Circulation would not go downwardly due to cement or packers sealing the lower annular area. If circulation was not established, the spear and packoff was removed from the wellbore and the cutter assembly was then re-run at a point higher in the hole. After the cut was made, the spear and packoff was re-run and another circulation attemp was made. Quite often this cumbersome procedure had to be repeated many times until circulation was established.

Another system utilized by Assignee was an assembly comprising a spear, a stabilizer and a hydraulic cutter. In this system, the casing was cut under tension and then pulled to ascertain whether the casing was free before the casing cutter was retrieved from the well bore.

The problem with this system was that it was not possible to pressure up on the cut, establish circulation and ascertain if there was a gas bubble or other problems behind the cut casing without using surface blowout preventers. As stated previously, operators were reluctant to do this.

SUMMARY OF THE INVENTION

The present invention obviates the above mentioned problems and shortcomings with prior art well abandonment systems by providing a system capable of cutting and pulling casing and also establish circulation prior to removing the assembly from the well bore.

The assembly comprises a string of components which includes a pipe cutter and a spear with the addition of a hydraulic expandable packing element that would run just below the spear.

With this assembly, the spear is set and the casing is cut. Thereafter the packer is inflated and set to determine if circulation could be established. If circulation can not be established, the spear would be unset and the entire assembly would be moved further up the hole to repeat the procedure.

A major advantage of the present invention is the inflatable packoff assembly would be operable to seal off the casing annulus upon demand without removing the pipe cutter and spear.

If circulation can be established immediately after the cut is made, less drilling fluid volume is required thereby resulting in substantial time savings.

Another advantage of the present invention is that the rig's safety devices are not employed during circulation attempts thereby improving safety.

The above noted objects and advantages of the present invention will be morre fully understood upon a study of the following description in conjunction with the detailed drawings.

DESCRIPTION OF THE PREFERRED EMBODIMENTS AND BEST MODE FOR CARRYING OUT THE INVENTION

Figure 1A:
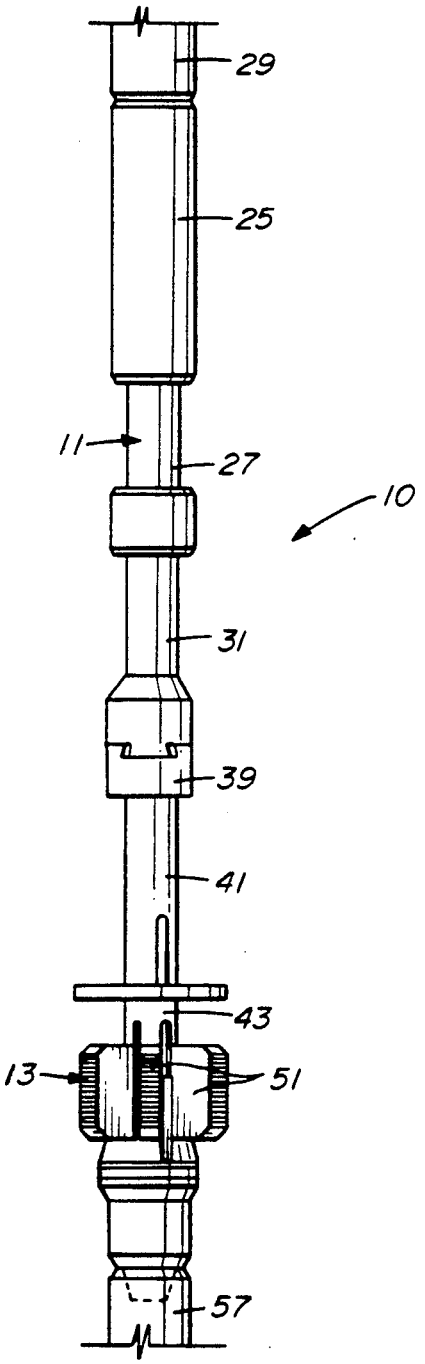
FIGS. 1A & 1B is a side elvational view of bottom hole assembly in accordance with the present invention.
Figure 1B:
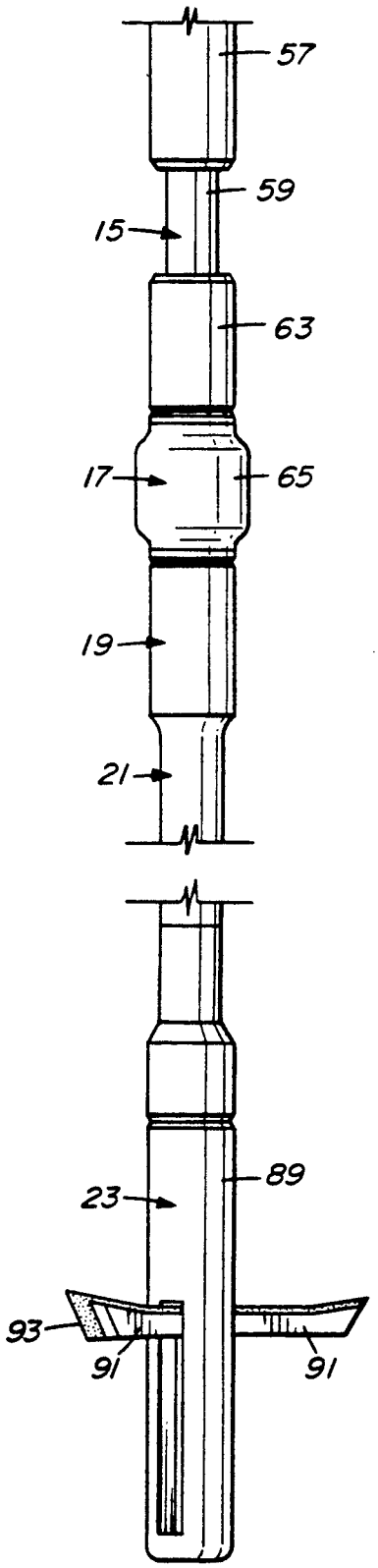

FIG. 1 illustrates the remedial bottom hole assembly, generally indicated by arrow 10, utilized in the well abandonment systtem of the present invention.

The remedial bottom hole assembly 10 includes generally, in descending order, a bumper sub 11, a spear 13, a second bumper sub 15, an inflatable packer 17, a ball catcher sub 19, a number of drill pipe or drill collars 21 and a pipe cutter 23.

The bumper sub 11 is conventional in construction and functions as an expansion joint in which two sections 25 and 27 are free to move vertically in relation to each other but are prevented (through spline means not shown) from rotating independently. The upper section 25 is adapted to be threadedly connected to the bottom member 29 of the drill string. With this tool 11 in the string the operator is able to deliver a sharp downward blow which is required to break the engagement of the spear 13, while still being able to transmit torque to complete the releasing operation.

The lower section 27 is adapted to be threadedly connected to the spear assembly 13.

Figure 2:
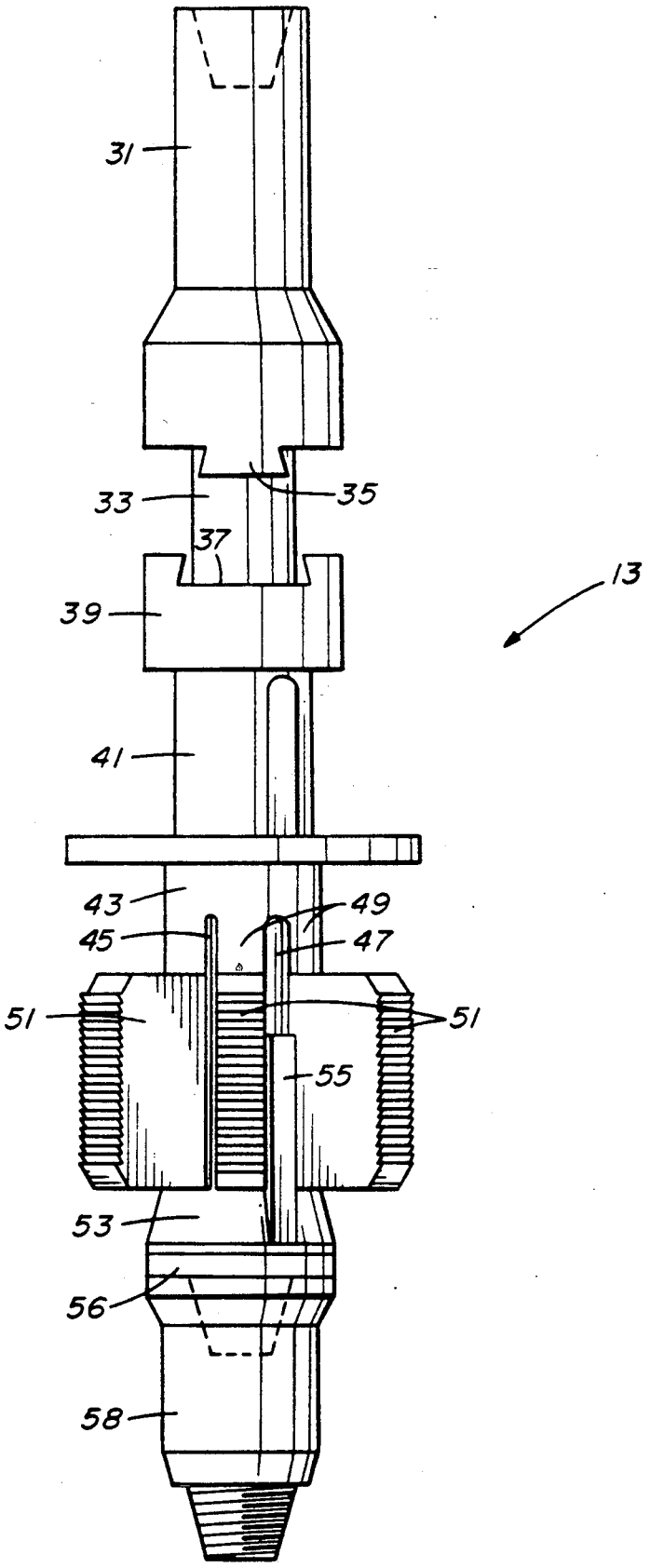
FIG. 2 is an enlarged elevational view of the spear utilized in the bottom hole assembly.

FIG. 2 shows an enlarged view of the spear 13 shown in its extended position. The spear 13 includes a top sub housing member 31 which is integrally connected to a mandrel 33. The lower end of the top sub 31 includes a projection 35 which is adapted to move downwardly into engagement with a slot 37 formed on a nut 39. The nut 39 is hollow to receive the mandrel 33. The nut 39, in turn, is connected to a slip mandrel 41 which is adapted to extend into a slotted cylindrical element 43. The cylindrical element 43 contains a plurality of thin slots 45 and wide slots 47 which extend to the lower extremity of the element to form a plurality of tongues 49 about the periphery thereof. A grapple block 51 is bolted or mounted on each tongue 49. The mandrel 33 extends downwardly through the nut 39, slip mandrel 41 and cylindrical element 43 in order to be connected to a conical mandrel 53. The conical surface of the mandrel 53 functions to urge against the tongues 49 and force the blocks 51 radially outwardly. In the position shown in FIG. 2 the conical mandrel also includes four projections 55 which are adapted to extend into the wide slots 47 of element 43 for applying a torque thereto. When it is desired to contact the grapples 51, the top sub 31 and mandrel 33 are lowered with respect thereto until the projection 35 is located within the slot 37 of the nut 39. This movement lowers the conical mandrel 53 downwardly with respect to the element 43 until the projections 55 are below the wide slots 47 and the movement of the conical surface away from the tongues 49 enables the grapples to move radially inwardly. A one-eighth turn of the top sub 31 and mandrel 33 causes the projections 55 to rotate under the grapples 51 for lifting purposes.

A thrust bearing 56 is positioned between the conical mandrel 53 and the bottom sub 58 of the spear 13.

The bottom sub 58 is adapted to be threadedly connected to the second bumper sub 15 which has upper and lower sections 57 and 59 that are identical and function in the same manner as sections 25 and 27.

The lower end of section 59 is threadedly connected to the inflatable packer 17.

Figure 3:
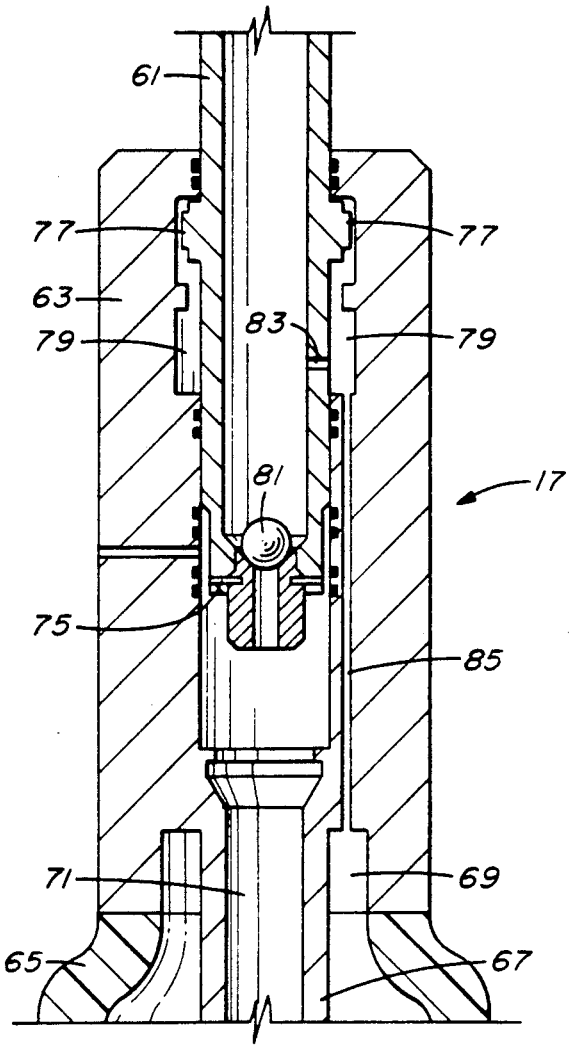
FIG. 3 is a sectional view of the inflatable packer in the inflating position.

As shown in FIG. 3, the packer 17 is run on the drill string, and includes an interior control mandrel 61 movable within the outer housing 63. The lower end of the outer housing 63 includes a flexible packer 65 extending around an inner casing 67 which separates the interior of the packer into the packer chamber 69 and a flow through chamber 71.

The lower end of the control mandrel 61 includes a ball choke 73 which is mounted thereon and held in position by a plurality of shear pins 75.

Figure 3A:
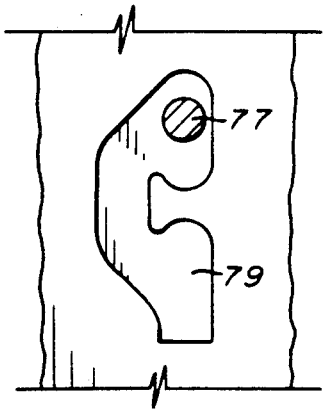
FIG. 3A is an enlarged sectional view of the j-slot taken along lines 3—3 of FIG. 3.

The middle of the control mandrel 61 includes a pair of projecting pins 77 which is adapted to move within a j-slot 79 (see FIG. 3A).

In the position shown and without the steel ball dropped in position, the fluid flow is allowed to pass through the interior of the tool through chamber 71. Upon dropping a steel ball 81 to seal at the choke 73, the fluid pressure passes through an orifice 83 and 85 to enter the packer chamber 69 to inflate the packer.

After inflation, the control mandrel 61 is picked up and rotated a quarter of a turn to the right. After slacking off the weight, the j-slot control guides the control mandrel 61 down thereby sealing the inflating port 83 (see FIG. 4A).

Figure 4:
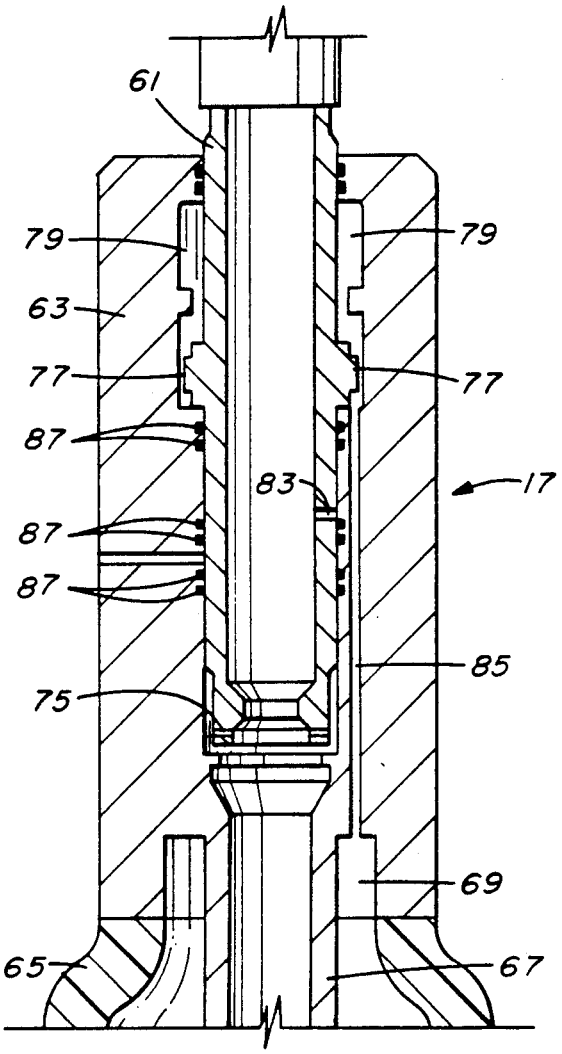
FIG. 4 is a sectional view of the inflatable packer in the operating position.
Figure 4A:
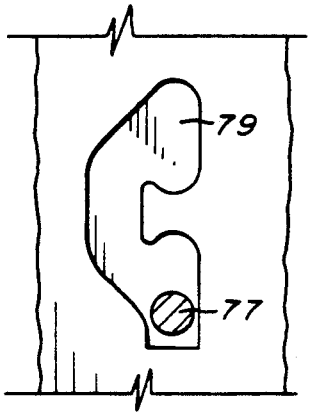
FIG. 4A is an enlarged sectional view of the j-slot taken along lines 4—4 of FIG. 4.

As shown in FIG. 4, the packer is isolated from pressure inside the work string. This is insured by a plurality of seals 87. With the packer inflated and the tool is ready to operate, the interior chamber is pressured up to shear the ball and choke, thereby opening the mandrel through the packer.

The ball catcher sub 19 is located directly beneath the packer 17 and is conventional in construction. The sub 19 functions to entrap the ball and choke while allowing fluid flow to pass therethrough.

Figure 5:
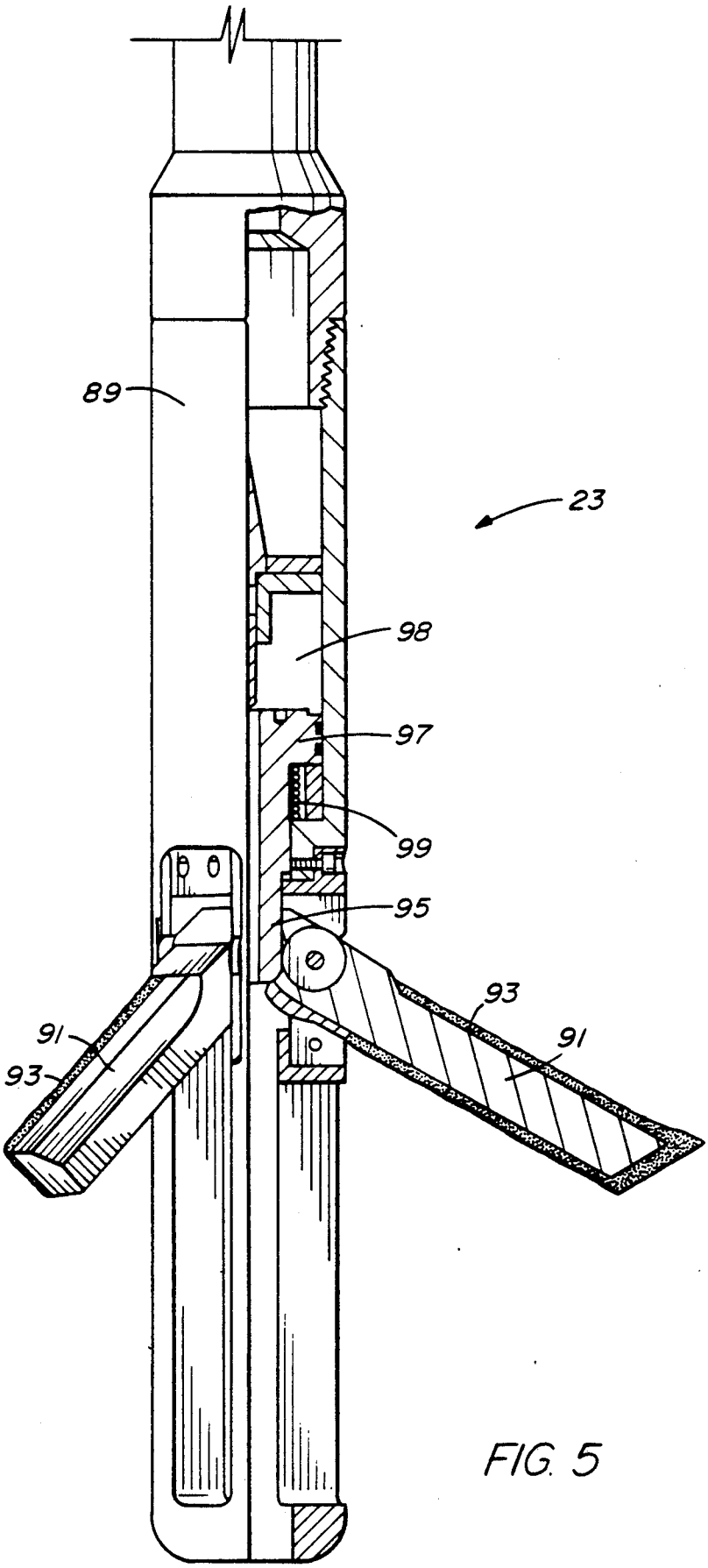
FIG. 5 is an elevational view, partially in section, of the pipe cutter utilized in the bottom hole assembly.

FIG. 5 illustrates the pipe cutter 23 which includes a main housing member 89 having a plurality of cutter arms 91 pivotally mounted thereon. The forward edge of each arm 91 includes a quantity of crushed tungsten carbide 93 bonded thereon. The movement of the arms 91 are governed by a cam-piston 95 which has a lower end for camming against the arms 91 and a piston end 97. The piston end 97 is located within a chamber 98 which is exposed to fluid pressure to move the piston 97 downwardly to pivot the cutting arms 91 outwardly. Below a certain pressure, a spring 99 is provided to move the piston 97 upwardly to allow the cutting arms 91 to pivot inwardly.

In operation the remedial bottom hole assembly 10 is lowered into a well bore a predetermined distance and landed at the point with the spear 13 in the catch position. A suitable overpull is taken to confirm positive engagement and then reduced to a working pull of 20,000 to 30,000 pounds tension.

Hydraulic pressure is then applied to the pipe cutter 23 in chamber 98 to activate the piston 95 which, in turn, cams the cutter arms outwardly. The drill string is then rotated to allow the cutter 23 to cut the well casing.

Upon completion of the cutting operation, the packer assembly 17 is actuated by raising the control mandrel 61 to the position shown in FIG. 3. At that point, the steel ball 81 is dropped onto the ball choke 73 and the system is pressured up to inflate the packer. Upon inflation, the control mandrel 61 is then lowered and additional pump up will cause the ball 81 and ball choke 73 to be sheared and dropped. hydraulic fluid then passes through the interior of the packer, down to the cut in the casing and hopefully up the outer annulus of the casing to establish circulation.

If circulation is not established, cutting string is set down to close the spear 13 and a one-eighth turn to the right be given to the cutting string to release the spear. The bottom hole assembly is then raised a predetermined distance and set again. After making another cut, a larger PVC ball is dropped into the packer 17 to close the bottom of the mandrel 61 and enable the packer to be inflated. The procedure shown in the description of FIG. 4 is then repeated in an attempt to establish circulation. The above procedure is repeated until circulation is established. The overpull is then increased to remove the cut section of pipe from the well along with the cutting string.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

What is claimed is:

1. A remedial bottom hole assembly for cutting and removing casing from a borehole comprising:

means for spearing the casing at a location within the borehole;

means located below the spearing means for cutting through a section of casing; and means located above said cutting means for packing the annulus between the casing and the bottom hole assembly.

2. The invention of claim 1 wherein said spearing means comprises a plurality of grapple blocks expandable radially outwardly by a conical mandrel.

3. The invention of claim 1 wherein said packing means comprises an inflatable packing member.

4. The invention of claim 1 wherein said packing means are located below the spearing means in the bottom hole assembly.

* * * * *